US005685445A

United States Patent [19]

Dobbs

[11] Patent Number: 5,685,445

[45] Date of Patent: Nov. 11, 1997

[54] ANTI-BACKOFF REMOVABLE CLOSURE FOR CONNECTING A MANUALLY ACTUATED LIQUID DISPENSER TO A CONTAINER

[75] Inventor: Douglas B. Dobbs, Yorba Linda, Calif.

[73] Assignee: Calmar Inc., City of Industry, Calif.

[21] Appl. No.: 490,531

[22] Filed: Jun. 14, 1995

[51] Int. Cl.[6] ..... B65D 41/04

[52] U.S. Cl. ..... 215/330; 215/216; 215/337

[58] Field of Search ..... 215/209, 216, 215/218, 221, 330, 331, 329, 337, 339, 295, 305

[56] References Cited

U.S. PATENT DOCUMENTS

| | | | |
|---|---|---|---|
| 4,231,479 | 11/1980 | Scheidegger | 215/305 X |
| 4,345,691 | 8/1982 | Burke . | |
| 4,577,769 | 3/1986 | Delia | 215/295 X |
| 4,913,299 | 4/1990 | Petro | 215/216 X |
| 4,991,733 | 2/1991 | Marino . | |
| 5,143,237 | 9/1992 | Lindsey et al. . | |
| 5,360,127 | 11/1994 | Barriac et al. . | |
| 5,381,911 | 1/1995 | Teicher et al. | 215/305 X |

*Primary Examiner*—Allan N. Shoap
*Assistant Examiner*—Robin A. Hylton
*Attorney, Agent, or Firm*—Watson Cole Stevens Davis, P.L.L.C.

[57] ABSTRACT

An anti-backoff, removable closure for connecting a manually actuated liquid dispenser to a container includes a closure cap having internal threads for mating engagement with similar threads on the outside of the container neck finish, both the cap and the neck finish having mutually engageable ratchet teeth mechanically retaining the closure to the container. The teeth inside the cap each have a trailing face lying in a plane sloping in a loosening direction of the cap relative to the central axis of the cap for producing a camming action between the cap teeth and the neck finish teeth, tending to cam the cap off the container in response to closure unthreading rotation.

5 Claims, 1 Drawing Sheet

ANTI-BACKOFF REMOVABLE CLOSURE FOR CONNECTING A MANUALLY ACTUATED LIQUID DISPENSER TO A CONTAINER

BACKGROUND OF THE INVENTION

This invention relates generally to a closure for connecting a manually actuated liquid dispenser to a container, the closure including a cap for connection to the dispenser, and being threaded to the container neck finish. More particularly, mutually engaging ratchet teeth on the cap and neck finish serve to mechanically retain the closure in place to avoid backoff during shipping, storage and handling. The ratchet teeth on the inside of the closure cap are specifically designed to facilitate cap removal by assisting to disengage the ratchets when unthreading the closure.

Ratchet closure caps for thread mounting manually actuated dispensers of the pump actuated type, for example, onto a plastic container, have been developed to both prevent cap removal or to permit cap removal with relatively greater rotation torque compared to a lower rotation torque required upon threading the closure to the container.

For example, U.S. Pat. No. 4,345,691 discloses a child resistant bottle closure for mounting a dispenser to a container, the closure having inside ratchet teeth mutually spaced apart for locking engagement with outer ratchet teeth on the bottle neck finish. The closure ratchet teeth and the neck finish ratchet teeth have mutually engageable trailing faces which extend radially and lie in planes containing the central axis of the closure to prevent the cap from being removed from the container.

U.S. Pat. No. 4,991,733 discloses a closure and container having passover, interengaging ratchet teeth, each having substantially flat outermost surfaces and each being formed with oppositely inclined surfaces with the inclines being of different degrees enabling inter-engaging surfaces of the teeth to easily pass over one another when the closure is revolved clockwise, and requiring considerably more torque when the closure is revolved counter-clockwise upon closure removal.

U.S. Pat. No. 5,143,237 discloses a ratchet cap for mounting a dispensing device onto a container, the ratchet teeth inside the cap having a rearwardly extending short back face and a forwardly extending long front face with the back face and front face forming an acute but almost rectangular angle, and the back face of one tooth extending from the long front face of an adjacent tooth, to prevent the cap from being loosened accidentally.

The closure ratchet teeth of the invention prevent closure backoff avoiding leakage of liquid product from the container to which the dispenser is mounted, yet facilitate closure removal for refilling the container, unlike that of the known prior art.

SUMMARY OF THE INVENTION

It is therefore an object of the present invention to provide an anti-backoff, removable container closure requiring a predetermined threshold torque for closure removal compared to the torque required for closure torque-down, in a simple and economical yet highly effective manner.

According to the invention, the ratchet teeth inside the closure are configured to easily cam over the bottle neck ratchet teeth when torquing down on the closure, the container ratchet teeth being mutually spaced apart and engaging the outside ratchet teeth on the bottle neck finish to prevent unintentional closure backoff. Each inside tooth has a trailing face which lies in a plane sloping from an upper end to a lower end thereof in a container loosening direction relative to the central axis of the cap for producing a camming action between the cap teeth and the neck finish teeth tending to cam the cap off the container upon unthreading the cap. The sloping angle may be in a range of 3 to 10 degrees, and the included angle between the leading and trailing face of each inner tooth on the cap may form an obtuse angle.

Other objects, advantages and novel features of the invention will become more apparent from the following detailed description of the invention when taken in conjunction with the accompanying drawings.

DETAILED DESCRIPTION OF THE INVENTION

Figure 1:
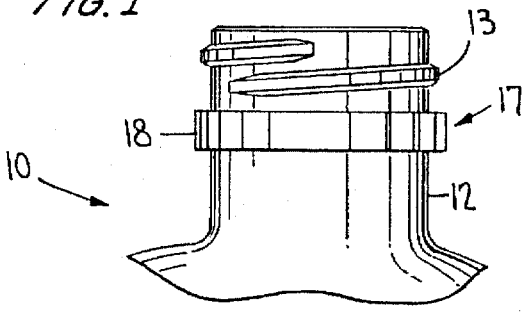
FIG. 1 is a side elevational view of a container, partly broken away, showing the container neck finish with which the closure according to the invention engages.
Figure 2:
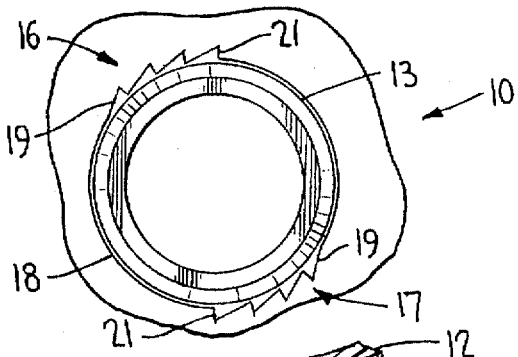
FIG. 2 is a top plan view of the container of FIG. 1.

Turning now to the drawings wherein like reference characters refer to like and corresponding parts throughout the several views, container 10 of FIGS. 1 and 2 is of a suitable molded plastic construction to which a manually actuated dispenser (not shown), such as a trigger actuated pump sprayer, is mounted by the provision of closure cap 11 of the invention connected to the dispenser in some suitable manner forming no part of the invention.

Figure 5:
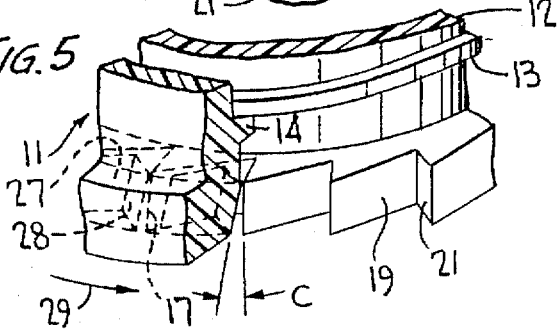
FIG. 5 is a perspective view of the closure of the invention threaded down and locked on the container neck finish, shown partly broken away.
Figure 4:
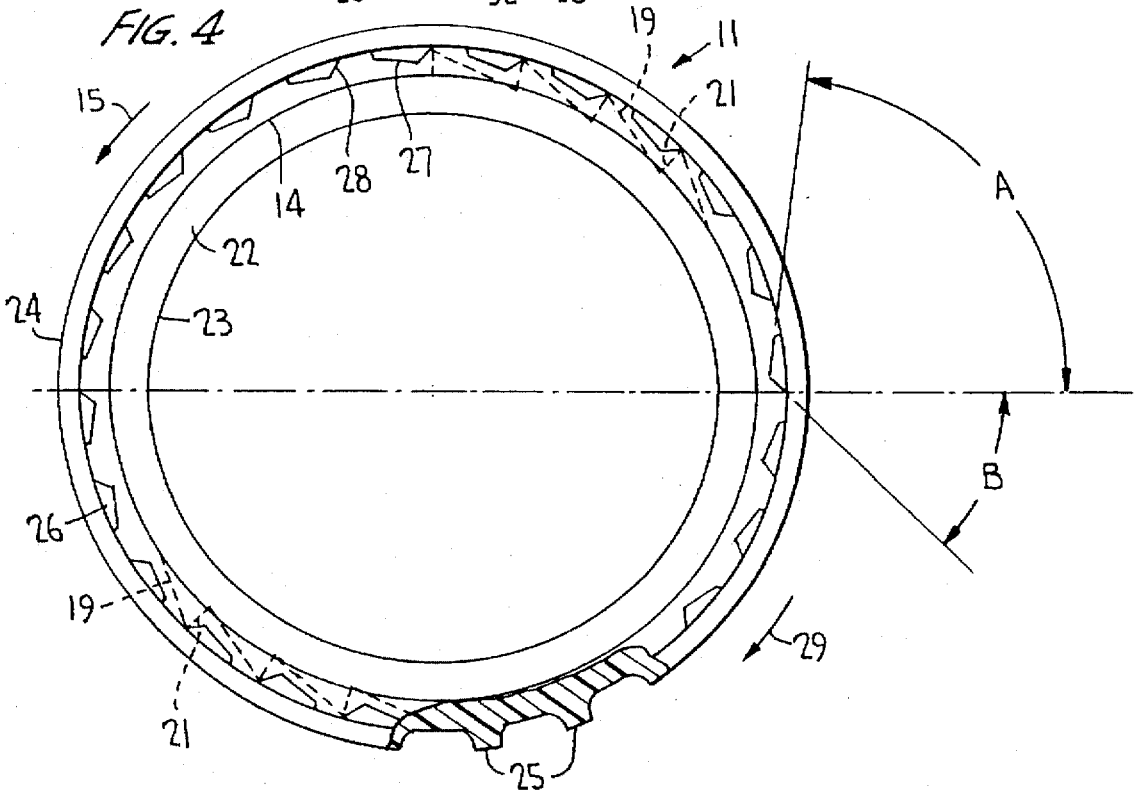
FIG. 4 is the bottom plane view of the closure taken substantially along the line 4—4 of FIG. 3, at a slightly enlarged scale.

The container has a cylindrical neck finish 12 with an external thread 13 for engagement with a like thread 14 on the inside of the closure cap upon cap rotation in a predetermined torquing-down direction shown by arrow 15 of FIGS. 4 and 5. A series of outside ratchet teeth 16, 17 are provided beneath thread 13 on the container neck finish on a ridge 18. The two sets of ratchet teeth may be spaced 180° apart and each may include four ratchet teeth, although each set may have more or fewer ratchet teeth than illustrated, without departing from the invention.

Leading face 19 of each tooth of each set 16, 17 is tangential with ridge 18 and trailing face 21 of each tooth of each set 16, 17 extends radially relative to the central axis of the container neck.

Upper wall 22 of the closure cap has a central opening 23 for the reception of the dispenser. The closure cap has a circular side wall 24 which may have formed thereon external vertical flutes 25 (FIG. 4) enabling the operator to grasp and rotate the closure cap in both directions without slippage.

Figure 3:
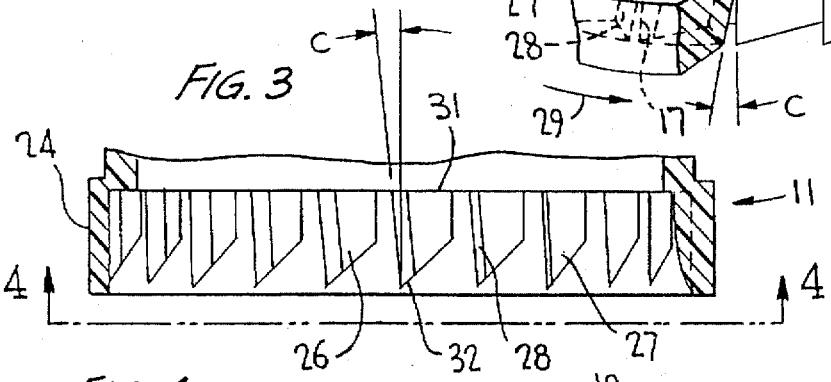
FIG. 3 is a vertical sectional view of the closure according to the invention at an enlarged scale and partly broken away.

A series of ratchet teeth 26 are formed on the inner surface of sidewall 24 of the cap beneath thread 14. The teeth are mutually spaced apart as shown in FIGS. 3, 4, each of the ratchet teeth having a relatively long leading face 27, and a relatively shorter trailing face 28. Leading face 27 of each of the teeth slopes outwardly in the direction of arrow 15, and trailing face 28 of each of the teeth slopes outwardly in the direction of arrow 29 (FIGS. 4, 5), which is the turning direction for cap removal.

As shown in FIG. 4, trailing face 28 of each of the ratchet teeth is spaced from the leading face 27 of an adjacent ratchet tooth, by a predetermined distance. The sloping angle A of leading face 27, relative to a radial line passing through the center of the cap, is shown at approximately 80°, but may vary as long as the sloping leading faces of the inner ratchet teeth approximate the slope of the leading faces 19 of the external ratchet teeth on the container neck finish to permit faces 27 to slide over faces 19 when torquing down the cap on the container until the external ratchet teeth (shown in dotted outline in FIG. 4 for convenience) engage behind the internal closure teeth as shown.

Trailing face 28 of each of the ratchet teeth inside the closure cap is sloped at an angle B from the radial line extending from the center of the closure cap, which angle B is shown at about 45°. This sloping angle may vary in slope to form an angle less or greater than 45°, without lying on a radial line connecting the center of the closure cap. The sum of angles A and B, which is the included angle between faces 27 and 28, is obtuse.

The slope of each trailing face 28 affects the depth of engagement of the external neck finish ratchet teeth which determines the torque required to remove the closure. A sloping angle B of about 45°, plus or minus about 10°, will permit the closure ratchet teeth to jump over the container ratchet teeth when a predetermined torque is applied for removal of the closure in the direction of arrow 29.

Interengagement between the inner and outer ratchet teeth can be relaxed somewhat upon squeezing together portions of sidewall 24 of the cap at locations other than at teeth 16, 17 while applying a turning torque to the cap in a loosening direction.

As an assist in closure cap removal according to the invention, inner ratchet teeth 26 on the closure are formed such that each trailing face 28 lies in a plane sloping from an upper end 31 to a lower end 32 thereof in a direction toward loosening direction 29 at a predetermined angle relative to the central axis of the cap. As illustrated in FIG. 5, this produces a camming action between the cap teeth and the back faces of the neck finish teeth, tending to cam the cap upwardly off the container in response to a closure unthreading rotation in the direction of arrow 29.

This predetermined angle C can be in the range of 3° to 10°. Thus, portions of the cap side wall need not be squeezed together at locations spaced from ratchet teeth 16, 17 to assure that the trailing faces of the closure ratchet teeth will jump over the bottle neck finish teeth when rotating the cap for removal. The camming action created between ratchet teeth 16, 17 and the vertically sloping trailing faces of the closure cap teeth result in a force vector component adding to the upwardly directed force vector created by the unthreading torque applied during an unloosening of the cap which thereby assists in forcing the closure upwardly during an unthreading of the cap.

Obviously, many modifications and variations of the present invention are made possible in the light of the above teachings. It is therefore to be understood that within the scope of the appending claims the invention may be practiced otherwise than as specifically described.

What is claimed is:

1. An anti-backoff, removable closure assembly for connecting a manually actuated liquid dispenser to a container, the assembly comprising a closure cap having an opening in a top wall thereof for receiving the dispenser, a cylindrical neck finish on the container, the cap and the container neck finish having threads for mutual tightening engagement upon cap rotation in a predetermined direction, means for removably locking the cap on the container when the cap is threaded thereonto, said means comprising a series of ratchet teeth inside the cap and on the outside of the neck finish arranged for mutual engagement, the teeth on the neck finish each having a radially extending trailing face lying in a plane containing the central axis of the neck finish, the teeth inside the cap extending between upper and lower ends thereof in a longitudinal direction parallel to a longitudinal central axis of the closure cap, and the teeth inside the cap being spaced apart from one another and each having a trailing face lying in a plane sloping from the upper end to the lower end thereof in a direction opposite said predetermined direction at a predetermined angle of at least 3° relative to the central axis of the cap for producing a camming action between the cap teeth and the neck finish teeth tending to cam the cap off the container in response to closure unthreading rotation in said opposite direction.

2. The closure assembly according to claim 1, wherein said predetermined angle is 3° to 10°.

3. The closure assembly according to claim 1, wherein an included angle between the trailing face and a leading face of each of the teeth inside the cap is greater than 90°.

4. The closure assembly according to claim 1, wherein leading faces of the teeth inside the cap are substantially parallel to leading faces of the teeth on the outside of the neck finish.

5. The closure assembly according to claim 1, wherein the neck finish ratchet teeth are arranged in a pair of radially opposed sets of ratchet teeth.

* * * * *